United States Patent [19]

Talvard et al.

[11] 4,077,336

[45] Mar. 7, 1978

[54] PRINTING DEVICE FOR HIGH SPEED PRINTERS

[75] Inventors: Jean-Pierre Talvard, St-Germain-les-Corbeil; Bernard Flaceliere, Chatenay-Malabry; Jacques Bunel, Vigneux-sur-Seine, all of France

[73] Assignee: Society Said: LOGABAX, France

[21] Appl. No.: 649,184

[22] Filed: Jan. 15, 1976

[30] Foreign Application Priority Data

Feb. 13, 1975 France ..... 75 04445

[51] Int. Cl.[2] ..... B41J 7/70

[52] U.S. Cl. ..... 101/93.05; 197/1 R

[58] Field of Search ..... 197/1 R; 101/93.04, 101/93.05; 178/30, 23 R; 346/78, 141

[56] References Cited

U.S. PATENT DOCUMENTS

| | | | |
|---|---|---|---|
| 2,773,443 | 12/1956 | Lambert | 101/93.05 |
| 3,742,846 | 7/1973 | Knappe | 197/1 R X |
| 3,759,359 | 9/1973 | Stellmach | 101/93.05 X |
| 3,789,969 | 2/1974 | Howard et al. | 197/1 R |
| 3,802,544 | 4/1974 | Howard et al. | 197/1 R |

OTHER PUBLICATIONS

Laybourn, "Resonant Reed Print Unit", IBM Technical Disclosure Bulletin, vol. 12, No. 12, May 1970, pp. 485–486.

*Primary Examiner*—Edward M. Coven
*Attorney, Agent, or Firm*—William Anthony Drucker

[57] ABSTRACT

Printer for printing machine comprising a plurality of styluses arranged in a plane parallel to the writing line and a corresponding number of electromagnets whose armatures cooperate with one end of the styluses mounted in a fixed guide, the other end being driven by a movable guide, characterized by means for subjecting the guide to a first alternating linear movement parallel to the writing line combined with a second alternating linear movement perpendicular to the first one, the amplitude of these linear movements corresponding to an integral number of characters printed in the form of dot matrixes.

The invention can be applied to high speed printers operating at 300 to 500 lines per minute.

6 Claims, 18 Drawing Figures

FIG. 6
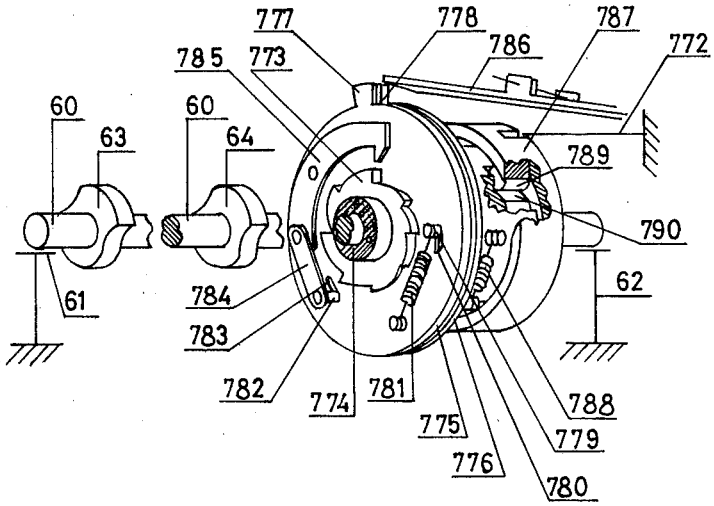
FIG. 7
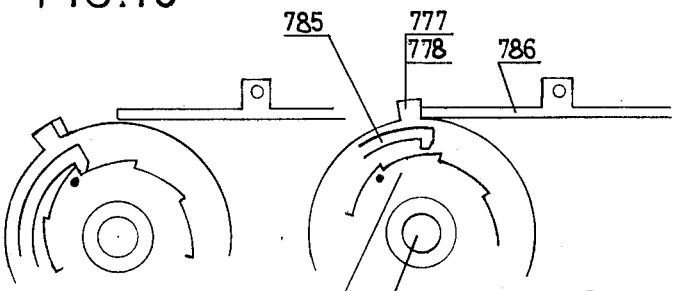
FIG. 8
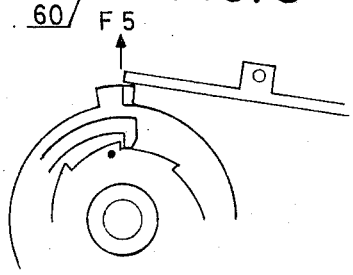
FIG. 9
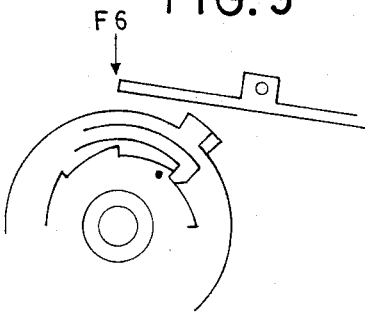
FIG. 10
FIG. 11
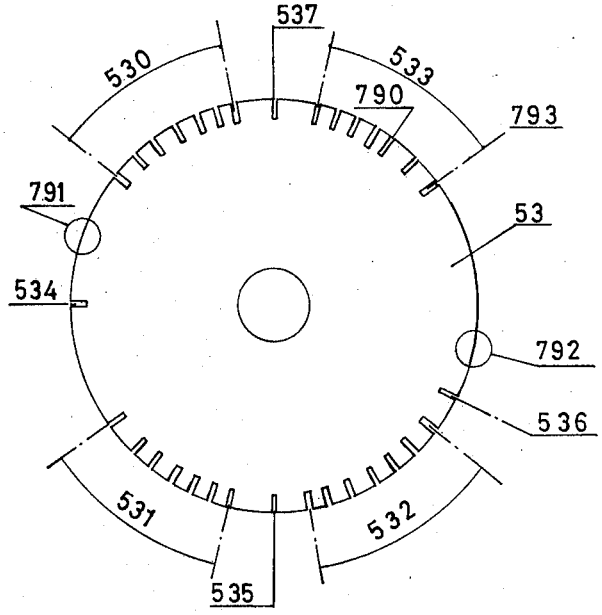

PRINTING DEVICE FOR HIGH SPEED PRINTERS

The present invention relates to printers used in printing machines, and relates more particularly to printers in which the printing of the characters is obtained in the form of a dot matrix by a movement of the ends of a set of metal styluses actuated by the armatures of a set of electromagnets controlled by the electronic elements of the machine.

Printers of this type are described more particularly in British Pat. No. 744,631 filed on May 7, 1954 by Powers-Samas Accounting Machines Ltd., U.S. Pat. No. 2,938,455 filed on Dec. 31, 1954 by Henry A. Turgers and Martin T. Kelly and French patent application No. 7,315,287 filed on Apr. 27, 1973 by Centronics Data Computer Corp., and permit the elimination of problems of inertia and mobile connection encountered in conventional printers, and consequently increases the printing speed.

In known printers of this type, the movable guide which drives the ends of the styluses performs a linear movement parallel to the writing line, the passage from one line of dots to the next being obtained solely by the displacement of the paper. As paper is a support with an elastic behaviour its continuous or stepwise unreeling during printing causes deformation of the characters. When unreeling is continuous the guide must be inclined relative to the writing line which prevents writing in the two displacement directions. When unreeling takes place stepwise the printing speed is limited.

The present invention eliminates these disadvantages and thus permits the full use of the possibilities offered by this type of device by eliminating any paper movement during printing and by effecting the passage from one line of dots to the next in the character by means of a vertical stepwise linear movement of the ends of the styluses performed at the end of each half-cycle of the horizontal displacement.

A printer of this type permits a printing in both directions as well as higher printing speeds.

According to a preferred embodiment, the transmission device effecting a discontinuous perpendicular linear movement comprises first means transmitting to second means a discontinuous oscillatory movement, whereby the said second means undergo in continuous manner an alternating linear movement parallel to the writing line whilst remaining integral.

The invention will be better understood from the following description with reference to the attached drawings:

FIG. 1 is a plan view of a printing member during the alternating displacement parallel to the writing line;

FIG. 6 is a schematic perspective view of a clutch according to a preferred embodiment of the invention;

FIGS. 7–10 are schematic views of the clutch of FIG. 6 showing the different possible positions which it can assume;

FIG. 11 is a schematic view of the device for starting off the printing dots;

FIG. 6 is the flow diagram corresponding to the operation of the sequencer of the device;

Figure 1:
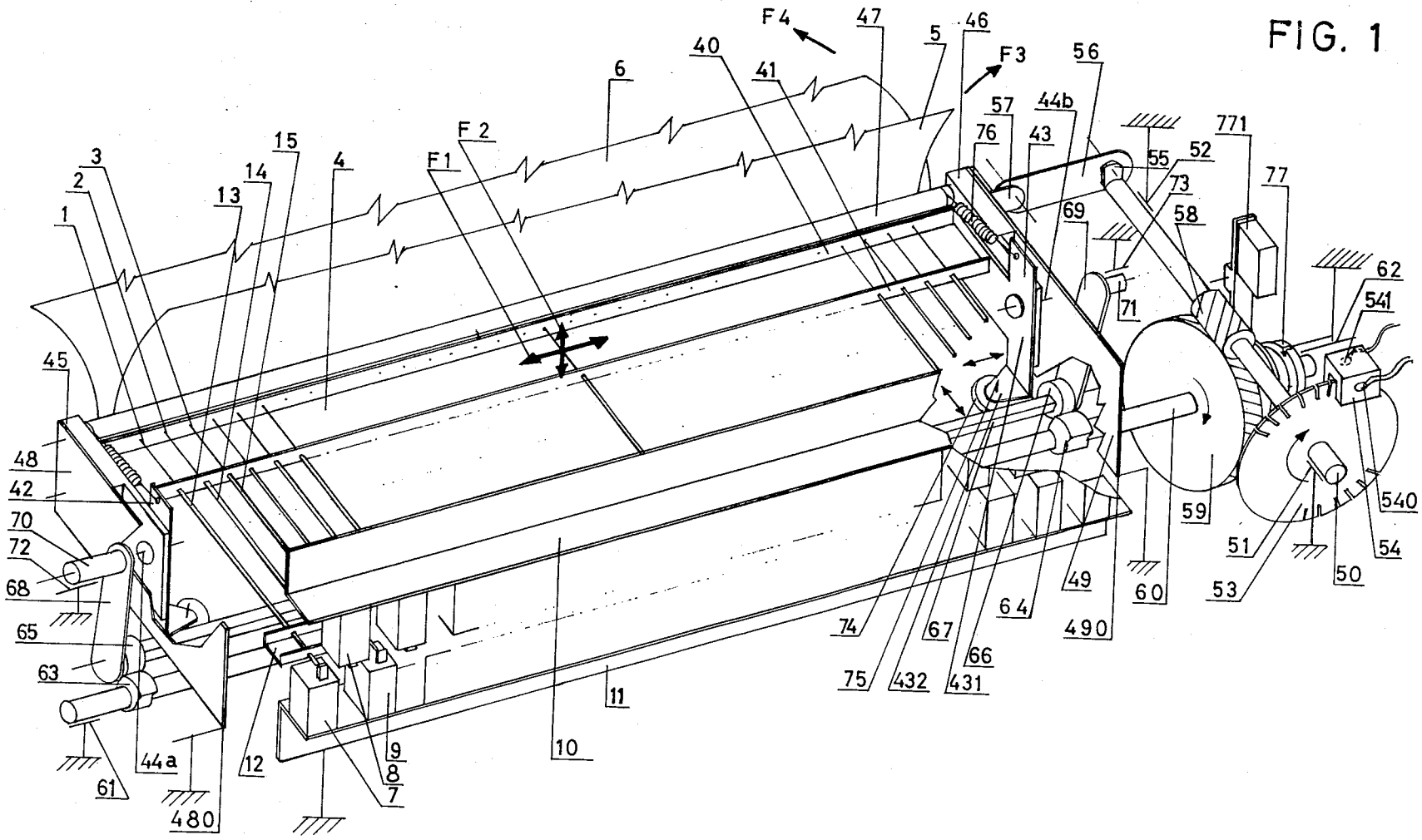
FIG. 1 is a schematic perspective view of a printer according to a preferred embodiment of the invention.
Figure 3:
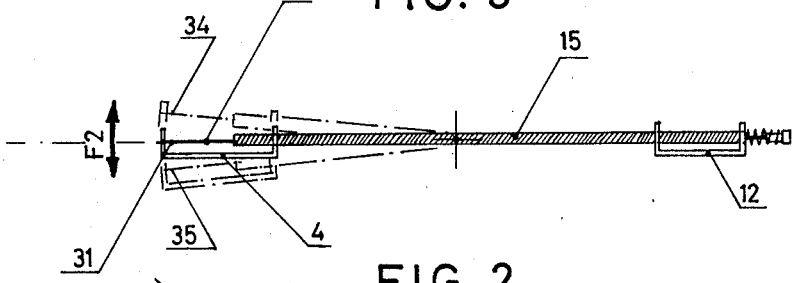
FIG. 3 is a profile view of a printer member during the alternating displacement perpendicular to the writing line.
Figure 2:
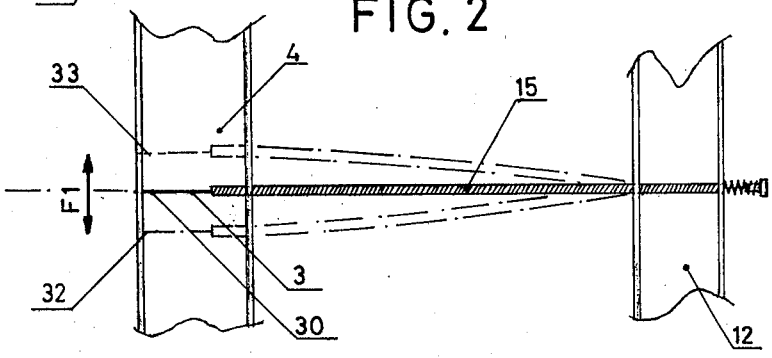

In FIGS. 1, 1, 2 and 3 are the ends of the N styluses whereof only a small number is shown for reasons of clarity of the drawing. These ends are supported by a movable guide 4 effecting a horizontal alternating linear movement in the direction of the double arrow $F_1$ combined with a vertical alternating linear movement $F_2$.

A ribbon 5 moves continuously in the direction of arrow $F_3$ and synchronously with the printing operation. Paper 6 moves in jumps in the direction of arrow $F_4$ at precise times to be defined hereinafter.

Electromagnets such as 7, 8, 9 are mounted on fixed supports 10, 11 of the printer frame in such a way that their movable armatures strike the opposite ends of the styluses (1, 2, 3 respectively). Each stylus moves in a sheath (13, 14, 15) whereof one end is integral with the fixed support 12. The other end of the sheath is fitted in the front wall of the movable guide 4.

The active end of each stylus easily performs the displacement transmitted to it by the guide without leaving its sheath and without danger of bending due to the guidance by the flexible sheath. The latter is advantageously of the type described in French patent application No. 7,022,241 filed by the applicants on 17-6-1970 for "Improvements to printing heads for printing machines". It comprises the sheath of a Bowden cable surface-lubricated by applying a lubricant which is introduced between the turns.

It can be seen that the ledge-shaped guide 4 comprises two cross-bars 40,41 having openings for the passage of the styluses and secured by two flanges 42,43. These flanges move around two aligned spindles 44*a*,44*b*. It can be seen that each flange has a vertical portion 431 extended by a horizontal lug 432.

Spindles 44*a* and 44*b* are integral with two blocks 45 and 46 fixed to the two ends of a rod 47 on the one hand, and to two flexible strips 48,49 on the other. The edges 480,490 of these strips are fixed to the machine frame. Its connections are shown symbolically to simplify the drawing.

The single not shown printer motor ensures displacements $F_1$ and $F_2$. To this end it controls the continuous rotation of a shaft 50 supported by two bearings represented symbolically at 51 and 52.

A slotted disc 53, driven by shaft 50 cooperates with an electrical pulse generator 54 comprising a light source 50 and a photoelectric connection 51. This generator serves to control the printing of characters as will be explained hereinafter.

At the opposite end of shaft 50 is driven an eccentric 55 controlling the displacement of a rod 56. Strip 49 is fixed to rod 56 by a lug 57.

A pinion 58 carried by shaft 50 meshes with a toothed wheel 59 mounted on a spindle 60 which is supported by two bearings 61 and 62 and supports two cams 63 and 64. Strip 49 has been exploded so that the cam 64 located behind the same is visible.

Cams 63 and 64 cooperate with two rollers 65 and 66 respectively. These two rollers are mounted at the ends of a square spindle 67 located in the same horizontal plane as spindle 60 and whereon are articulated two levers 68,69. At their opposite ends these levers are articulated on two shafts 70,71 mounted in overhung manner in bearings 72,73 respectively and aligned with spindles 44*a*,44*b*.

A roller 74 idles about a spindle 75 perpendicularly to lug 432 and rolls on one of the faces of spindle 67.

A spring 76 connects rod 47 to flange 43. A clutch 77 is used to fix cam 64 to wheel 59. This clutch is put into operation by an electromagnet 771 controlled by signals from the electronic circuits of the printer.

The operation of the printing head described hereinbefore is as follows. The writing is of the mosaic type and is performed for each character, according to a regular matrix of A dot lines by 3 dot columns (A and B being integers greater then 1). In the specific example herein illustrated A=B=7. Each dot is marked by the impact of the movable end of a stylus on the ribbon placed in front of the paper when the corresponding electromagnet receives from the electronic circuits of the printer an appropriate excitation signal. Each character line is formed by a number of dots which is determined by the shape of the character, and which can be a maximum equal to 4. These dots are separated by a step of 0.508 mm. The shape of the character can require a half-step displacement of these dots. The space between two characters is formed by the width difference of the character and the standardised character step of 2.54 mm.

The number N of styluses in a submultiple of the total number of characters in each line and according to a preferred embodiment, N = 68, for a number of characters equal to 136 per line.This permits each stylus to perform the complete printing of the dot line portion corresponding to several characters (e.g. two characters, in the example herein disclosed). However, the number N could also equal the total number of characters, each stylus then printing only one character per line. In order to print these points guide 4 undergoes an alternating horizontal movement, printing taking place during each linear movement from right to left and left to right. The useful displacement amplitude of guide 4 is 5.08 mm in the present embodiment. In the position of maximum displacement of its end, the stylus continues to perform correct printing. This horizontal backwards and forwards displacement of the end of the styluses lasts 30 ms. when considering a printing speed 500 lines per minute.

The horizontal movement $F_1$ of the ends of the styluses effected by guide 4 is shown in FIG. 2. As will be explained hereinafter, at the end of each line of dots guide 4 effects a vertical linear step of movement permitting the ends of the styluses to print the next line of dots. This movement $F_2$ is shown in FIG. 3. The average positions of stylus 3 during the movements $F_1$ and $F_2$ are shown as 30 and 31 in FIGS. 2, 3 and 4. The extreme positions which can be assumed by the stylus are shown as 32, 33, 34 and 35.

Figure 4:
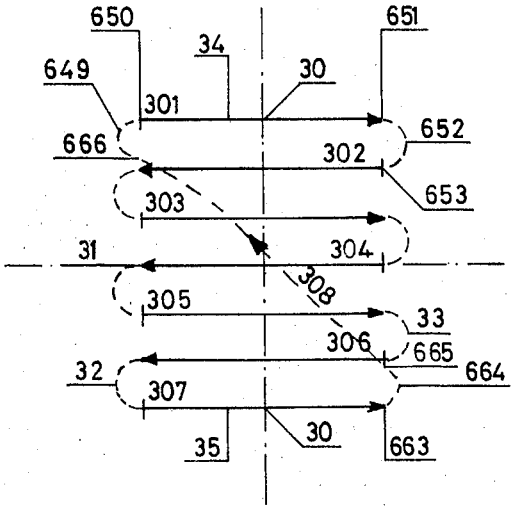
FIG. 4 is a schematic view of the displacement of the ends of the styluses on the paper support.

The combined movement performed by the end of the styluses to effect the printing of a matrix is shown in FIG. 4. The writing half-cycles 301 to 307 correspond to the writing of the seven dot lines of the matrix. The dotted line curves correspond to an appropriate combination of the horizontal alternatingmovement $F_1$ and the vertical movement $F_2$. These curves are obtained through a synchronisation process to be described hereinafter.

Half-cycle 308 is a rapid return half-cycle corresponding to the re-setting to the starting point of the ends of the styluses. The end of any one of the half cycles 301 to 308 is 15 ms.

During half-cycle 308 the paper makes a jump which permits the printing of the following line of characters as soon as the end of the styluses returns. The synchronisation of the rapid return of the end of the styluses and of the paper jump is effected in the manner to be described hereinafter by the sequencer of the electronic part of the printer. The movement of guide 4 described hereinbefore is obtained in the following manner. For writing a line of dots, i.e. a writing half-cycle, shaft 50 of FIG. 1 transmits an alternating horizontal linear movement to rod 56 and consequently to the assembly constituted by strips 48,49, flanges 42,43, locks 45,46, cross-bars 40,41 and rod 47. This movement is then continuously applied by the cross-bars to the ends of the styluses.

Figure 5:
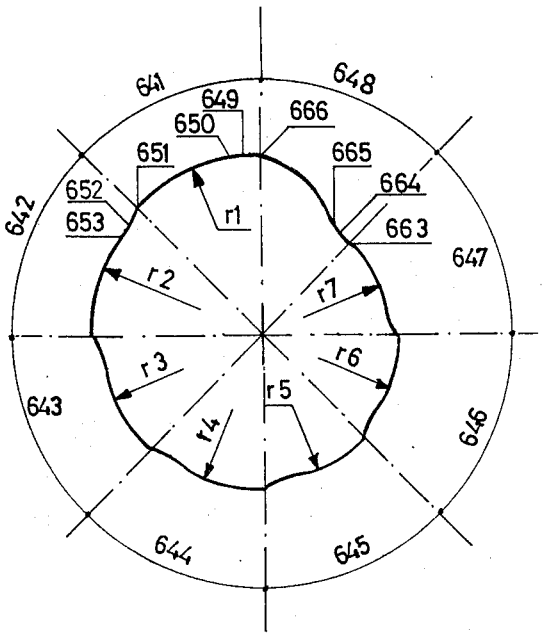
FIG. 5 is a schematic view of a cam with a stepped cylindrical profile.

At the end of each line of dots the line jump is obtained in the following manner corresponding to the dotted line configuration of FIG. 4. The horizontal movemement is combined with a vertical movement produced by cylindrical cams 63,64 whose profile is shown in FIG. 5.

It can be seen that they are angularly distributed in eight equal portions 641 to 648. Portions 641 to 647, completely as regards the first and partly as regards the others, are formed by circular arcs of radii $r_1$ to $r_7$. These radii progress in accordance with a ratio proportional to the distance between two dot lines of the writing matrix, i.e. 0.37 mm. These circular arcs connected by identical curves corresponding to the profile of roller 66 such as 651 to 653 and 663 to 665 which are concave towards the outside and form seven stages. The same reference numerals as in FIG. 4 are used to designate the points reached by the end of a stylus and the corresponding contact points of roller 66 and cam 64. On the circular arc 64 passing from point 666 to point 651 is indicated a reference 650 whose importance will be explained hereinafter. Returning now to FIG. 1, roller 66 by cooperation with stages 641 to 647 performs seven successive jumps during the rotation of this cam. By cooperating with portion 648 it then performs a continuous rotation movement of an eighth of a turn. Roller 66 rotating about spindle 67 imparts to it by means of lever 69 an oscillatory movement about spindle 71 at each jump corresponding to the stages of cam 64.

Roller 64 resting on one of the faces 67 follows the oscillatory movement of the said spindle and imparting it to lug 432 and guide 4. Moreover, it follows an alternating linear movement by rolling on one face of spindle 67 under the action of lug 432 of flange 43.

In the embodiment considered disc 53 rotates at 2,000 revolutions per minute for a half-cycle period of 15 ms. Pinion 58 and wheel 59 form a reducing gear with a ratio of 4 so that the rotation speed of cam 64 is 500 revolutions per minute. Thus, one revolution of the cam corresponds to eight half-cycles.

FIG. 4 shows that the first half-cycle commences at reference 649 which corresponds on the cam profile to the centre of circular arc 666 - 650 and terminates at reference 652 which corresponds to the centre of circular arc portions 651 to 653. The first printing strike takes place at reference 650 and the last at reference 651. Between these two references the movement of the end of the styluses is horizontal. This movement continues in the same direction up to reference 652, but as from reference 651 it is supplemented by a vertical movement given by the circular arc change effected by roller 66 and the profile of cam 64. At reference 652 representing the start of the second half-cycle the horizontal movement changes direction whilst the vertical movement continues up to reference 653. At reference 663 end of the styluses undergoes an upwardly directed vertical movement which lasts to reference 650. The direction of the horizontal movement is reversed at reference 664 representing the end of the seventh half-cycle and the start of the rapid return, and at reference 649 the end of the rapid return and the start of the first half-cycle.

At the end of each line of characters, i.e. as from reference 663, the paper performs a jump which is terminated at reference 650.

In the above description it has been assumed that the rotation movement of cam 64 is continuous. In fact, due to clutch 77 it is only controlled when the electronic part of the machine has a sufficient number of characters in the memory store for the printing of these characters to require several rotations of the cam, i.e. several cycles comprising eight half-cycles. This makes it unnecessary for the cam to rotate permanently no matter whether the ends of the styluses are printing characters or not, leading to the advantage of minimizing wear to the cam. Guide 4 thus undergoes a non-permanent vertical movement and continuous alternating horizontal movement.

FIG. 6 shows a preferred embodiment of clutch 77. This clutch comprises a ratchet wheel 773 having eight teeth integral with spindle 60 as a result of a driving means 774. This spindle also carries two discs 775,776 each having a stop member 777,778 repectively. These two discs are connected by a spindle 779 which slides in a slot 780 permitting the displacement of these discs under the action of a spring 781 whilst still remaining secured. These two discs are also connected by a spindle 782 which slides in a slot 783. Spindle 782 is integral with a rod 784 acting on a pawl 785.

The electromagnet 771 of FIG. 1 operates clutch 777 by means of a blade 786 and is controlled by the sequencer of the electronic part of the printer.

A free wheel 787 fixed to the machine frame at 772 is connected to disc 776 by a spring 788. It is exploded in FIG. 6 so as to show the roller 789 rolling on a flat 790.

FIGS. 7 to 10 show four relative positions of the clutch and of the electromagnet blade corresponding to the angular positions of disc 53. The position of FIGS. 7 corresponds to the state of the clutch before writing a line of characters. Blade 786 is at rest against stop member 777,778. The discs are at rest whilst wheel 773 permanently rotates about spindle 60.

The sequencer of the electronic part of the printer energizes electromagnet 771 which thus controls the lowering of blade 786 in accordance with arrow $F_5$ which permits spring 781 of FIG. 6 to slide spindle 779 into slot 780 and thus to displace disc 776 relative to disc 775. Consequently spindle 782 slides into slot 783 and raises pawl 785 which falls onto wheel 773 between two teeth. This corresponds to the position shown in FIG. 8.

As the wheel rotates constantly, pawl 785 abuts against one of the teeth which has the effect of interlocking it with the movement of wheel 773. Thus, both the discs and cam 64 are caused to rotate, whereby the latter performs one revolution.

The position of FIG. 9 corresponds to the engagement of the pawl between the teeth of the wheel.

The blade which was raised at the passage of stop member 777,778 dots in accordance with arrow $F_6$ when these stop members have performed approximately a quarter of a turn.

During the rapid return 648 of cam 64 the electronic part of the printer, if still receiving information, controls the raising of blade 786 when the pawl is in the position shown in FIG. 10 so as to permit the passage of the two stop members of the clutch. In this case the cam continues to rotate permitting the writing of another line of characters. In the opposite case if the electronic part no longer receives information, blade 786 remains lowered and the stop members are supported thereon, stop member 777 arriving first and stop member 778 arriving by inertia.

FIG. 11 shows disc 53, to be described herinafter, representing the coincidence points of the slots and the photoelectric connection corresponding to the different positions shown in FIGS. 7 to 10. Slots 790 and 793 correspond to the positions of FIGS. 7 and 10 and zones 791 and 792 to the positions of FIGS. 8 and 9.

The free wheel 787 has three rollers whereof only one is shown in FIG. 6, whereby each can roll on a flat in a direction determined by spring 788 which has the effect of preventing any return of discs 775 and 776.

Ratchet wheel 773 permits the control of the start of a revolution of the cam no matter what the writing direction as a result of its eight teeth. The speed of shaft 60 is in fact such that a revolution of ratchet wheel 773 corresponds to eight halfcycles of the movement of the ends of thestyluses.

It is stressed that the mechanical device described hereinbefore secures the paper during the seven writing halfcycles which represents a considerable advantage. The paper only moves during the eight half-cycle corresponding to the return to the starting point of the ends of the styluses.

Writing takes place from right to left and from left to right no matter what the direction thereof which limits the synchronisation time.

The general organisation of the printer is conventional nd comprises a data introduction and control member, a character generation and control logic, a supply system, electromagnet amplifiers and the printing unit described hereinbefore.

Figure 12:
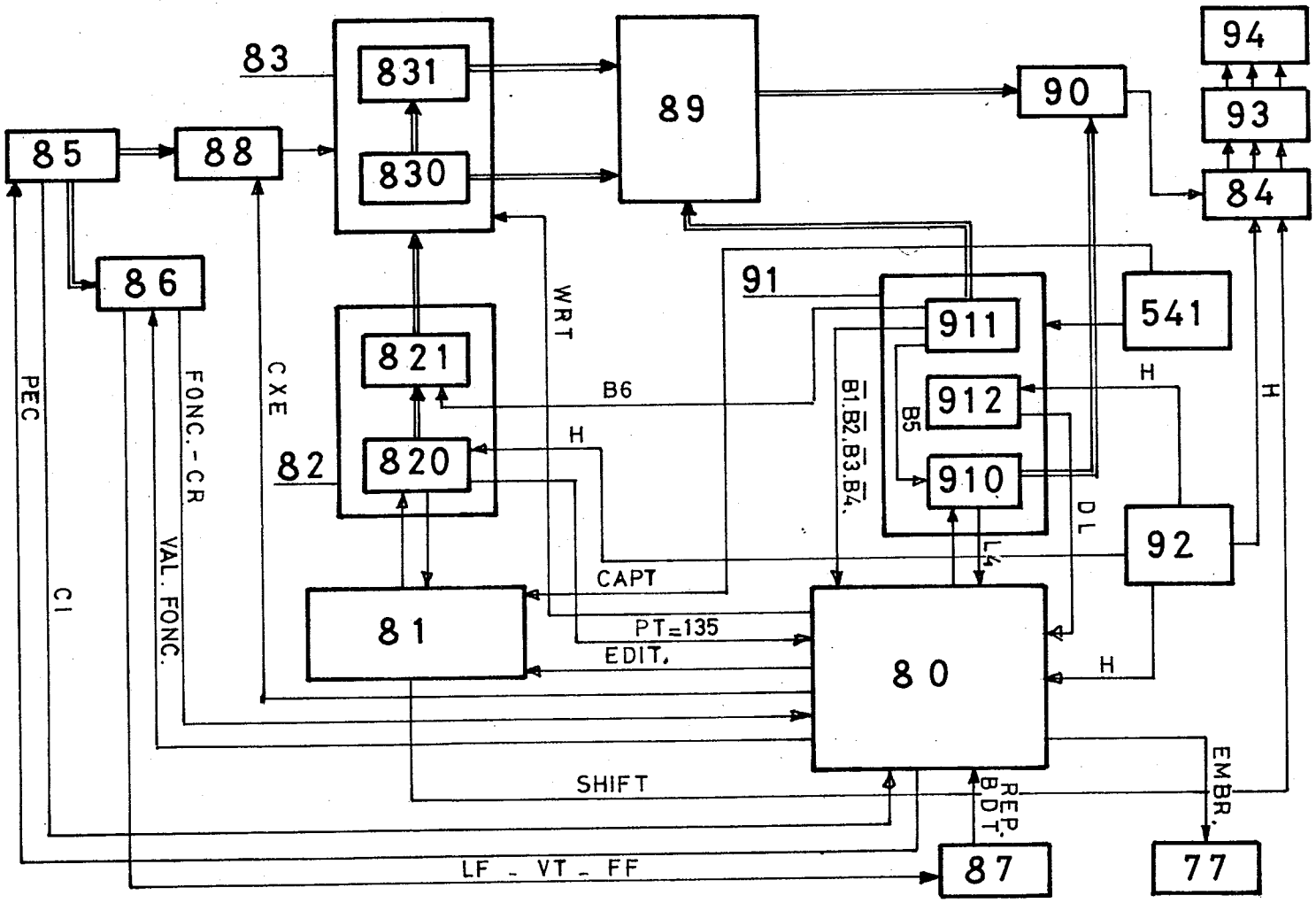
FIG. 12 is the functional diagram of the electronic device of the printer.

FIG. 12 shows the general organisation of the character generation and control logic. This logic comprises in per se known manner and main sequencer 80 controlling clutch 77 and supplemented by an edition sequencer 81 which generates the control pulses of an addressing system 82 comprising a counter 820 and a selector 821 controlling the addresses of an active memory 83 on the one hand, and a shift register 84 on the other. Counter 820 transmits information relative to its state to sequencers 80, 81. Memory 83 consists of two blocks 830 and 831 conventionally called a random access memory (RAM). These RAM have a capacity of 256 four bit words each. The inputs, outputs and addresses of these RAM have been reduced to a single arrow for reasons of simplicity and are in fact constituted by eight parallel lines. The filling order of these RAM is addressed directly thereto be sequencer 80.

The data introduction and control member 85 which is either a keyboard of a computer or a modulator-demodulator transmits its orders to a function decoder 86 which controls, depending on the function received either sequencer 80 which addresses to it an answer signal, or a paper raising system 87 which addresses to sequencer 80 information relative to its state. The data concerning the characters coming from member 85 is coded in eight bits ASCII and loaded into memory 83 through a switching member 88 controlled by sequencer 80. Memory 83 supplies the address bits to read only memory (ROM) 89 which forms with a multiplexer 90 the character generator. Read only memory 89 comprises four memory blocks which can only be read and contain the graphisms of the characters used by the printer and have a capacity of 256 octets, i.e. 64 characters of 8 octets. The code used has 8 bits, the three high-weight bits being used for the selection of the ROM where the character in question is located, and the five low-weight bits are used for the selection of the character in the said ROM. The data relative to a character come from the ROM in parallel to activate multiplexer 90 which transmits them in series to the shift register 84.

The addressing of multiplexer 90 and memory 89 is performed by a system 91 which supplies the exact address of the character to be printed by specifying by means of a line counter and a noted columns counter 910 and 911 respectively. A monostable device 912 ensures the zeroing of the flip-flops comprising the column counter 911. The column counter is controlled by sequencer 80 and transmits back to it data relating to the completion of a line of characters. The column counter on the one hand transmits data to sequencer 80 and on the other hand controls selector 821 because the output of one of the flip-flops forms an input of selector 821 as will be shown hereinafter.

The addressing system 91 receives data from photoelectric connection 541 which emits pulses which are also transmitted to edition sequencer 81.

A clock 92 emits pulses transmitted to register 84, to mono-stable device 912, to counter 820 and to sequencer 80.

Shift register 94 controls a logic system 93 acting as a mask which only permits the passage of information when register 84 is full. When this is the case, system 93 permits the energization of the amplifiers of styluses 94.

Disc 53 of FIG. 1 which controls the photoelectric connection 541 has, as shown in FIG. 11, four series of slots 530 to 533 and four isolated slots 534 to 537 placed between the series. Slot 536 is staggered relative to the diametrically opposite position of slot 534. The series 530 to 533 each comprises seven slots corresponding to the seven dots of a matrix line used for writing a character. Each stylus prints two characters during one half-cycle of its linear movement. Thus, the disc has two series of seven slots for each half-cycle. Slot 536 corresponds to the extreme left position of the styluses. Its displacement permits the detection of this position and the emission of a line start signal as will be explained hereinafter.

The different operations determined by the main sequencer and the different signals produced are itemised hereinafter:

$\bar{B}1$, $\bar{B}2$, $\bar{B}3$, $\bar{B}4$: signal emitted by the column counter 911 indicating the start of a line;

CAPT: signal emitted by photoelectric connection 541;

CI = O: printing command;

1 ← CXE: connection command of member 83;

DL: signal supplied by photoelectric connection 541, analysed by mono-stable device 912 and indicating the extreme left position of the styluses;

EDIT: edition signal

EMBR: clutch 77

F: coincidence between a slot of disc 53 and photoelectric connection 541;

FONC: function code: CR carriage return, FF page jump, LF line jump, VT paragraph jump;

LGN: zeroing order of line counter 910;

L4: heavy-weight bit of line counter;

L4 = 1: end of edition;

PEC: sequencer answer signal indicating that an instruction has been correctly performed;

O → PT: zeroing signal of counter 820;

1 → PT: incrementation of counter 820;

REPBDT: answer from paper movement control system;

SHIFT: displacement order of shift register 840;

VALFONC: validation order of the function detected by the sequencer;

WRT: order of writing into memory 83.

Figure 13:
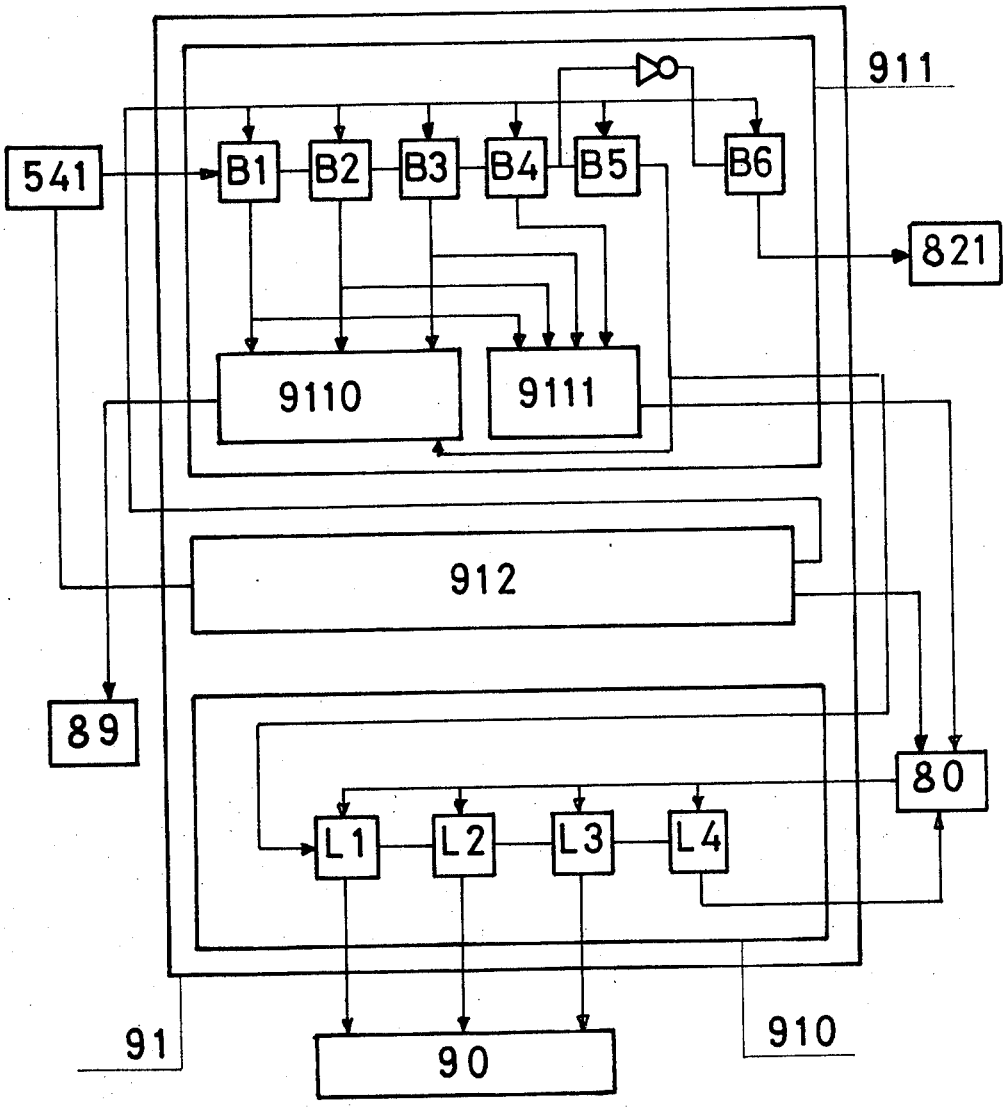
FIG. 13 is the functional diagram of the addressing system of the character generator of the electronic device.
Figure 14:
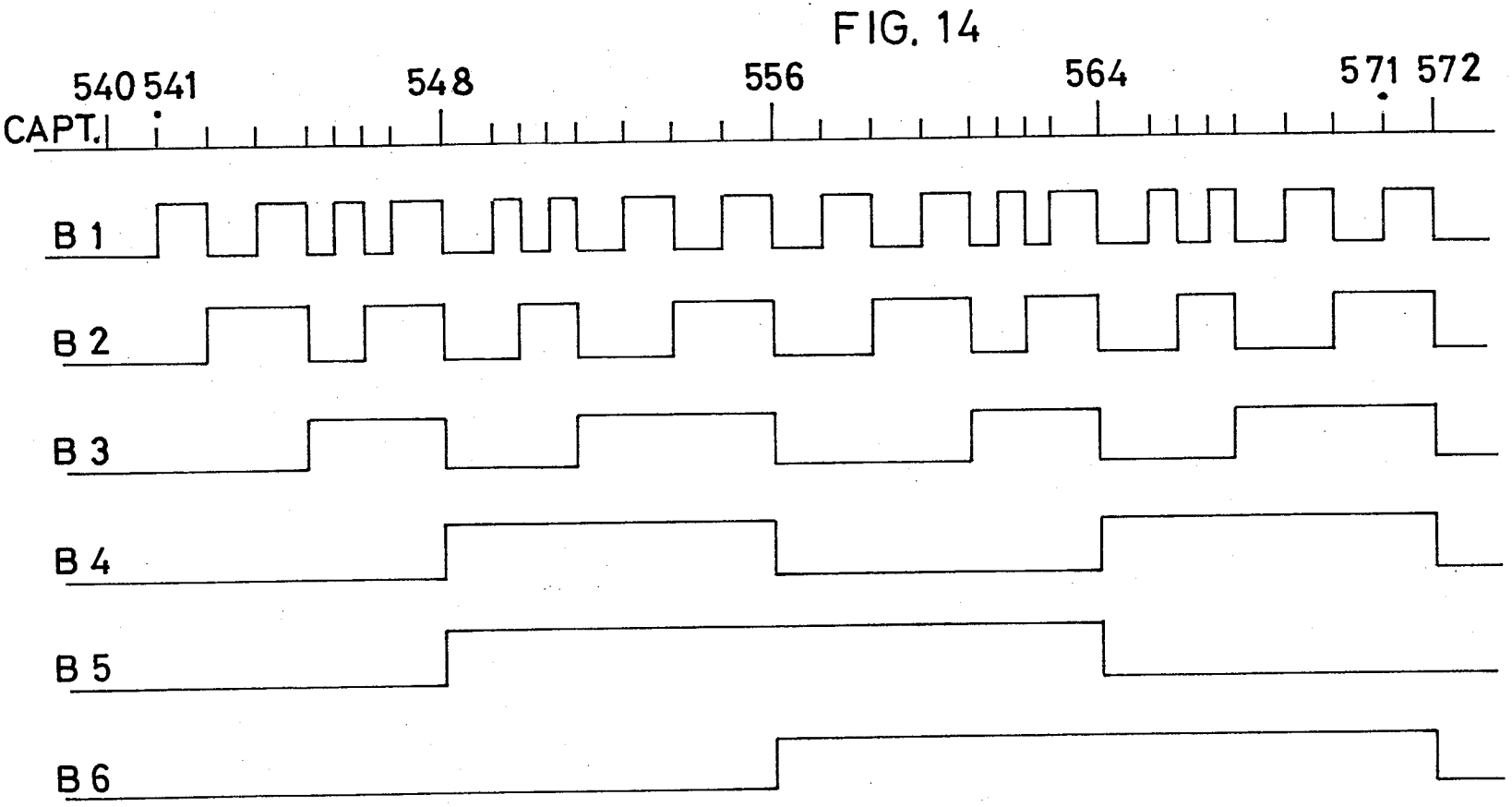
FIG. 14 is the timing chart of the different flip-flops forming the system of FIG. 13.

The addressing system 91 of the ROM formed by counters 910 and 911 as well as mono-stable device 912 is specifically described relative to FIG. 13. Column counter 911 comprises six flip-flops B1 to B6 operating in accordance with the timing chart shown in FIG. 14. Photoelectric connection 541 emits a CAPT signal formed by pulses 540 to 571 corresponding to the slots of disc 53. The four series of pulses 541 to 547, 549 to 555, 557 to 563 and 565 to 571 are given by the series of slots 533, 530, 531, 532 shown in FIG. 11 and pulses 540, 548, 556, 564 by slots 536, 537, 534, 535.

Pulse 541 permits the printing of the first dot of the character of the first line located to the left of the extreme position of the styluses. This character is the first to be printed if the printing of the first line takes place from left to right, in the opposite case pulse 557 is involved.

Flip-flop B1 counts the pulses given by photoelectric connection 541, thereby the negative fronts of flip-flops B1, B2, B3, B4 respectively control flip-flops B2, B3, B4, B6 and the positive fronts of flip-flop B4 control flip-flop B5. Thus flip-flop B4 changes state at each change of character and at each change of line, whilst flip-flop B6 changes state at each change of character, i.e. when the stylus passes through its median position and flip-flop B5 changes state at each change of line, i.e. every two characters. Returning to FIG. 13, a logic system 9110 controlled by flip-flops B1, B2, B3, B5 makes it possible to give an address which evolves from 0 to 7 when printing from left to right and from 7 to 0 when printing from right to left. This signals supplied by flip-flops B1 to B4 are decoded by system 9111 which transmits a line start signal to sequencer 80.

Flip-flop B5 also controls line counter 910 formed by three flip-flops L1, L2, L3 which gives the line address to multiplexer 90 and a flip-flop L4 which changes state every eight lines.

Mono-stable device 912 emits a signal DL which zeros the flip-flops of the column counter. This signal DL is emitted when the mono-stable device, which receives the pulses produced by the photo-electric connection determines a sufficiently large gap between two pulses, i.e. after pulse 40 which corresponds to gap 536 of disc 53.

The zeroing of the line counter flip-flops is directly performed by the sequencer. Edition sequencer 81 is formed by a system of logic gates analysing the signals received: EDIT-CAPT and controls the addressing system 82. It has a SHIFT output which transmits a displacement order to register 84 in accordance with the timing of FIG. 15.

Counter 820 of addressing system 82 has eight outputs symbolically represented by a single arrow which activates selector 821. Counter 820 moves differently depending on the input data transmitted by sequencer 80 and thus orders two different operating modes relative to selector 821.

If the input data orders the filling of the RAM, counter 820 moves from 0 to 135.

Figure 15:
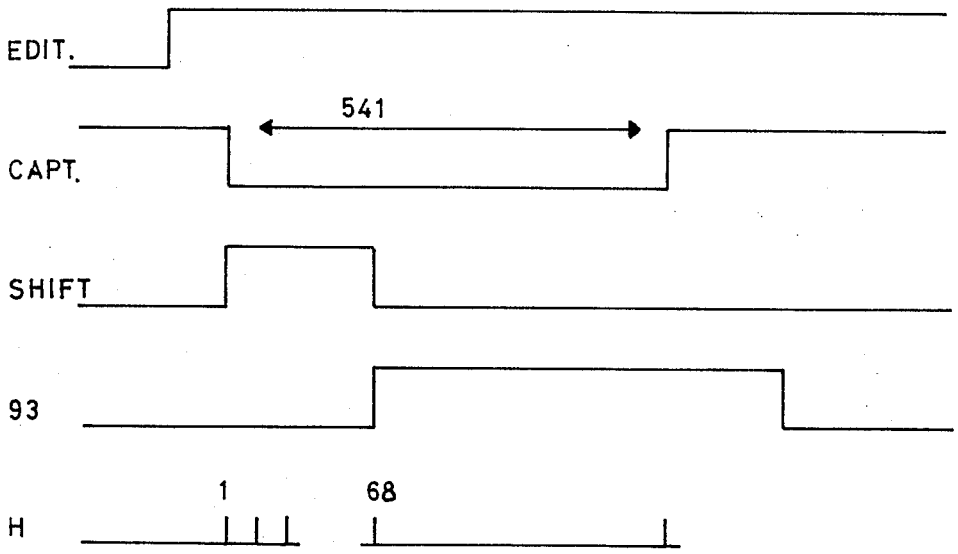
FIG. 15 is the timing chart of the addressing system of the active memories and of the output register of the device.

If the input data orders edition, counter 820 moves from 0 to 67 by counting the pulses given by clock 92 in accordance with the timing of FIG. 15.

Selector 821 has nine inputs which are on the one hand the eight outputs of counter 820 and on the other the output of flip-flop 6 and also eight outputs. Depending on the state of counter 820, the input controlled by input B6 may or may not be selected. This flip-flop changes state at the change of character indicating whether the character is odd or even, i.e. to the left or right of the median position of the styluses.

During the filling of the RAM the selected inputs are the inputs corresponding to the outputs of counter 820 permitting the latter to move from 0 to 135. During the edition the input corresponding to the output of flip-flop B6 replaces the input corresponding to the low weight bit of the counter which permits the address to move in twos from 0 to 135, thus controlling the printing of odd characters, or from 1 to 135 for even characters. Sequencer 80 substantially comprises four flip-flops JK and two decoders which determine 14 different states constituting ten orders used in the flow diagram shown in FIG. 16.

Figure 16:
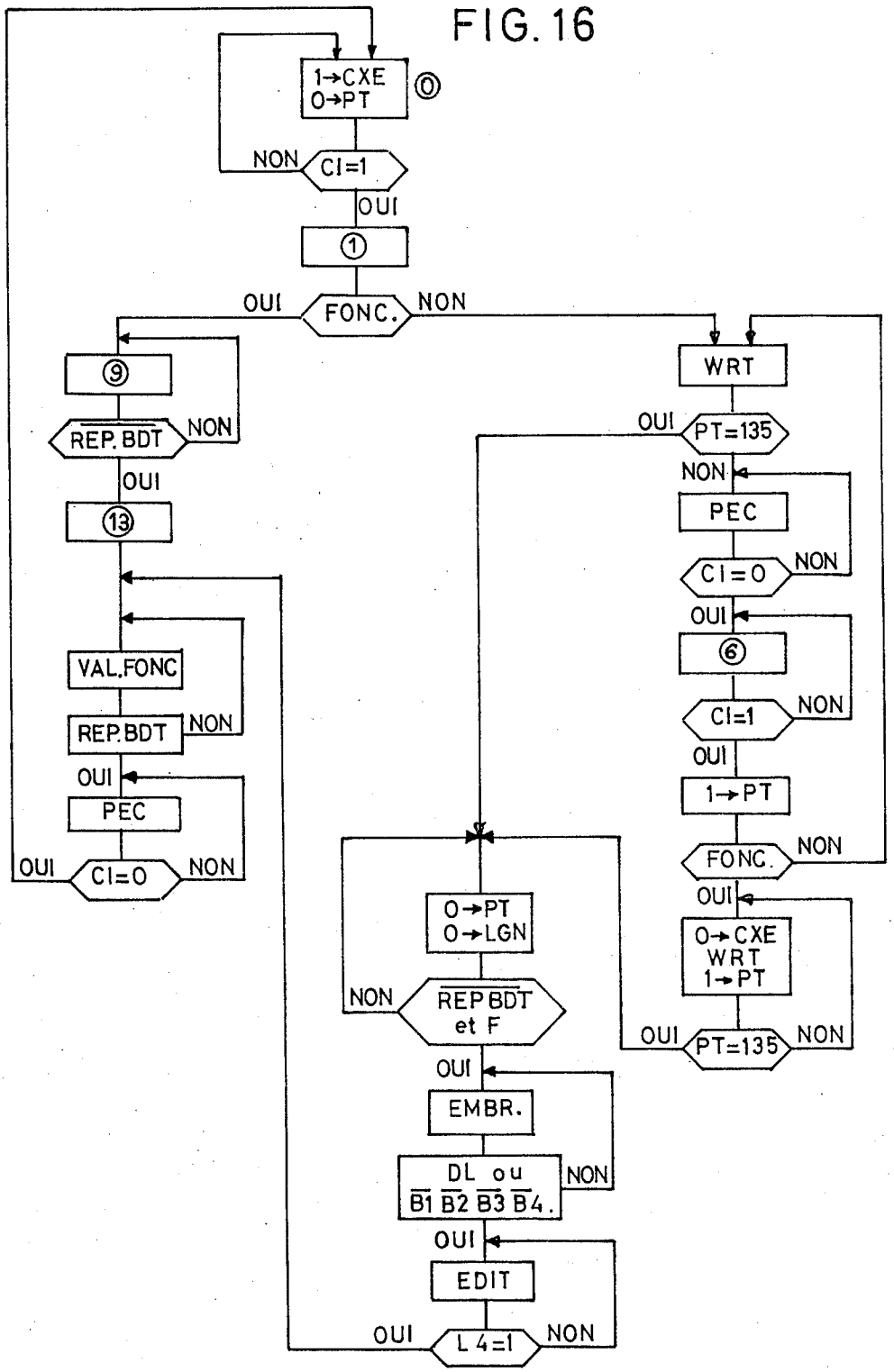

It receives data from the data introduction member 85 which can be character code data or function code data. The said data are analysed by the sequencer which determines the operations to be performed. FIG. 16 indicates the performance of these operations.

On energizing the system the sequencer which is in the initial state (O) arranges an input connection order transmitted to member 88 (1 → CXE) and zeros counter 820 (0 → PT). When these two operations are performed the sequencer receives a printing control order from the control member which places the sequencer in waiting state (1).

Figure 17:
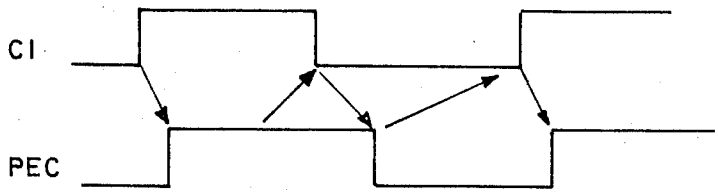
FIGS. 17 and 18 are timing charts of different signals emitted by the sequencer of the device.

If the data received is not an FONC data the sequencer commands by order WRT the filling of the RAM and checks the state of counter 820. On receiving the order CI the sequencer transmits an answer PEC to the control member as shown by the timing in FIG. 17. Sequencer state (6) constitutes a waiting state during which the order CI is restored. Counter 820 is then incremented by one unit indicating that one character has been stored in the RAM. If the following order is not a function order writing in the RAM continues in parallel with the incrementation of counter 820. If the order is a function order the input connection order is cancelled. If the counter does not display number 135, writing continues filling the blanks of the RAM until the latter are full. When this condition is reached, column counter 911 is zeroed as is line counter 910. After checking the stability of paper raising system 87 and the position of disc 53 corresponding to the coincidence of slot 790 and photoelectric connection 541, operates clutch 77 so that it is located in the position of FIG. 7. When this condition is realised, the sequencer receives a signal DL or a signal $\overline{B1}$, $\overline{B2}$, $\overline{B3}$, $\overline{B4}$ which indicates that the ends of the styluses have respectively reached positions 650 or 653 of FIG. 4 depending on whether writing commenced to the right or to the left. The sequencer then emits an edition order EDIT which is subsequently developed and is transmitted to edition sequencer 81. This edition is at an end when the sequencer receives from line counter 910 a signal L4 indicating that the edition of eight lines of dots is terminated.

Figure 18:
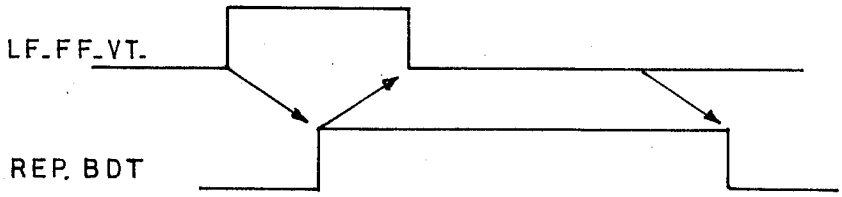

If the sequencer receives a function order, after checking the state of the paper raising system 87 it transmits a VALFONC answer to member 86 indicating that the function order has been received. It then receives from the paper raising system a REPBDT answer which intervenes at the time indicated by the timing of FIG. 18. The sequencer then transmits the answer PEC to member 85 which has the effect of cancelling order CI. States 9 and 13 form sequencer waiting states.

Edition takes place in the following way. The first pulse 541 or 557 gives the ROM the address of the first dots of the 68 even characters and the control member 85 determines the nature of these characters which are then selected in the ROM. The information bits relative to the first dots reach register 84 in series and the latter loads them. System 93 makes it possible for the register to transmit the data when the latter is full, i.e. when it has received 68 bits. The determination of this state is obtained by receiving the SHIFT order which indicates that the counter 830 is displaying the number 68 as shown by the timing of FIG. 15. When this condition is obtained the 68 data bits are transferred to amplifiers 94. This operation takes place for each pulse given by photoelectric connection 541.

The above disclosure shows that the invention provides a printer which can print, with the paper remaining fixed, either from left to right or right to left and which achieves, for example, access times below 25 ms and striking speeds of 300 lines per minute.

We claim:

1. An impact printer for forming dot patterns upon a movable document in a line by line fashion whereby a regular matrix of A dot lines by B dot columns defines each character, A and B being real integers greater than 1, comprising: a plurality of N elongated reciprocating styluses each having first and second ends, N being a number obtained by dividing the total number of characters in each line by a whole number including unity;

a plurality of N electromagnet means cooperating with the first ends of the respective styluses for driving the second ends thereof against the said document at high speed;

means for selectively energizing said electromagnet means;

first and second guide members by which the first and second end portions of the styluses are respectively supported at regularly spaced intervals along first and second imaginary straight lines substantially parallel to the dot lines;

said first guide member being fixedly mounted, whereas the second guide member is mounted for first reciprocating cyclic motion in the direction of the second imaginary straight line and for second reciprocating motion in a plane perpendicular to said second imaginary straight line;

motor means and a rotating shaft constantly rotated by said motor means when said motor means is energized;

first coupling means connecting the said shaft to the second guide member and adapted for converting the constant rotating motion of the said shaft into the said first reciprocating cyclic motion, the said first reciprocating cyclic motion being constant and having an amplitude corresponding to the line portion defined by the said total number of characters, divided by N;

second coupling means connecting the said shaft to the second guide member and adapted for converting the constant rotating motion of said shaft into the said second reciprocating motion, the said second reciprocating motion including a plurality of discrete downward steps each starting before the end of one of the successive half cycles of the first reciprocating cyclic motion and ending after the beginning of the next half cycle, the number of steps in said plurality equalling A-1 and a single step return upward translatory alternation movement starting at the end of the last of the said successive half cycle and ending at the end of the next half cycle, the totality of said downward steps together forming a downward translatory alternation movement having an amplitude equalling the length of a column, the said means for selectively energizing the electromagnet means being operative only during those portions of the first reciprocating cyclic motion are comprised between the said discrete downward steps;

and means for effecting a step of motion of the movable document during the said upward translatory alternation movement.

2. An impact printer as claimed in claim 1, wherein the said second guide member includes an horizontal cross-bar, and the said second coupling means includes two vertical support members secured at the respective ends of the cross-bar, means for pivotally supporting the said support members about an horizontal axis parallel to said cross-bar, two rollers pivotally mounted about vertical axes at the respective ends of the support members, two vertically arranged further rollers integrally connected to the ends of a horizontal bar, said bar having a flat surface portion on which engage the pivotally mounted rollers, means for pivotally mounting said bar about the said horizontal axis; an horizontal shaft parallel to said horizontal axis; cam means, mounted about said horizontal shaft, for cooperation with said two further rollers and means for coupling said horizontal shaft to the said rotating shaft.

3. An impact printer as claimed in claim 2, wherein the said first coupling means comprise an eccentric mounted on the said rotating shaft.

4. An impact printer as claimed in claim 2, wherein the said means for coupling the horizontal shaft to the rotating shaft includes a clutch and control means for operating said clutch.

5. An impact printer as claimed in claim 4, wherein the said means for energizing the electromagnetic means comprise a disc integrally mounted on said rotating shaft and having a plurality of light transmitting areas, a source of light and photoelectric detector units mounted for cooperation with the respective light transmitting areas and resulting in the generation of control signals, the said light transmitting areas including first and second pluralities of groups of B regularly distributed light transmitting areas, the number of groups in each plurality equalling the total number of characters in each line, divided by N; the said disc further having first and second light transmitting areas located between the first and second pluralities, and selecting means connecting the photoelectric detector units to the clutch control means and to the electromagnet means respectively, for selectively transmitting to the clutch control means the control signals generated by the photoelectric detector units through cooperation with the further first and second light transmitting areas and transmitting to the electromagnet means the control signals generated by the photoelectric detector units through cooperation with the light transmitting areas of said first and second pluralities.

6. An impact printer as claimed in claim 1, wherein N is half of the total number of characters in each line.

* * * * *